US005844360A

United States Patent [19]

Jeong et al.

[11] Patent Number: 5,844,360

[45] Date of Patent: Dec. 1, 1998

[54] FIELD EMMISSION DISPLAY WITH AN AUXILIARY CHAMBER

[75] Inventors: Hyo Soo Jeong, Seoul; Young Rae Cho, Kyonggi-Do; Jae Yeol Oh, Kyonggi-Do; Moon Jae Do, Kyonggi-Do, all of Rep. of Korea

[73] Assignee: Institute for Advanced Engineering, Seoul, Rep. of Korea

[21] Appl. No.: 703,976

[22] Filed: Aug. 28, 1996

[30] Foreign Application Priority Data

| | | | |
|---|---|---|---|
| Aug. 31, 1995 | [KR] | Rep. of Korea | 95-28142 |
| Aug. 31, 1995 | [KR] | Rep. of Korea | 95-28143 |
| Mar. 9, 1996 | [KR] | Rep. of Korea | 96-6217 |
| May 14, 1996 | [KR] | Rep. of Korea | 96-15901 |

[51] Int. Cl.[6] ..... H01J 1/62

[52] U.S. Cl. ..... 313/495; 313/336

[58] Field of Search ..... 313/309, 336, 313/351, 495, 496, 497, 392

[56] References Cited

U.S. PATENT DOCUMENTS

| | | | |
|---|---|---|---|
| 5,150,005 | 9/1992 | Yokono | 313/495 |
| 5,223,766 | 6/1993 | Nakayama et al. | 313/495 |
| 5,525,861 | 6/1996 | Banno et al. | 313/495 |
| 5,578,900 | 11/1996 | Peng et al. | 313/495 |

*Primary Examiner*—Richard Chilcot
*Assistant Examiner*—Harshad Patel
*Attorney, Agent, or Firm*—Bryan Cave LLP

[57] ABSTRACT

Evacuation of the volume of a field emission display can be carried out more easily by attaching the auxiliary chamber of various shape to the main space of a field emission display, which enlarge the volume of the field emission display. Several types of auxiliary chambers are attached to the main space of a field emission display and the resultant structures are described. The main purpose of the present invention is to introduce the method of providing the space for placing getters and increasing the conductance of the system to evacuate by enlarging the total volume of the field emission display.

14 Claims, 7 Drawing Sheets

FIELD EMMISSION DISPLAY WITH AN AUXILIARY CHAMBER

FIELD OF THE INVENTION

This invention relates to a field emission display (hereinafter "FED"), which can be used as a display device, and a fabrication method thereof. More particularly, this invention relates to a FED device having improved conductance of gas flow in the FED panel, an enlarged effective area of picture plane which represents picture images, and an auxiliary chamber providing a space for placing getters to remove gases in the FED panel after exhausting process.

BACKGROUND OF THE INVENTION

Field emission displays (FEDs) are applicable to information displays in many situations where the volume associated with conventional cathode ray tube displays(CRTs) is a major disadvantage such as portable computers, television sets and head mounted displays. FEDs have the advantage of relying on the well developed cathodoluminescent phosphor approach of CRTs while providing a particularly thin, simple and high resolution display formed in large part by techniques used to form integrated circuit.

The FED comprises of cathode electrodes addressed in matrix form, gate electrodes which controls the emission currents, anode electrodes coated with cathodoluminescent phosphor on one side opposing the cathode electrodes and spacers which maintain the spacing between cathode and anode electrodes uniform. Electrical signals are provided by lead lines connected to a control system outside. Electrons ejected from the emitters by the electrical signal produce picture images by impinging of the electrons upon a phosphor layer of the face plate, which resultingly leads to provide desired information. The cathode to anode gap should be made as small as possible and to be uniform to reduce the required voltage to operate the FED, to obtain uniform resolution and brightness and to avoid display distortion. In addition, for the emitted electrons to travel freely through the volume surrounding the FED and impinge upon an image face plate, to prevent the electrical break down and to keep from any attack by the ionized gas molecules under the high potential near the cathode, it is necessary to maintain high vacuum, typically less than $1\times10^{-6}$ torr, in the FED. However, as a conventional vacuum packaging technology has limitations in evacuating the small volume like FEDs, some new methods which overcome the shortcomings of the prior arts must be invented.

In the evacuation process in prior arts, an opening for exhaustion is formed to a portion of a base plate where emitters are not formed and pumping out the gas molecules in the panel is carried out through exhaust tube which is connected to the opening for exhaustion. When an appropriate low pressure is achieved, the exhaust tube was sealed off. A getter can be placed in the panel or in the exhaust tube in order to remove residual gases after exhaustion process. As described above, the picture image size, i.e., an effective area for providing information, which is produced on the face plate, is proportional to the active area of the electron emission devices which are fabricated on the base plate. However, as in the FED of prior arts the opening for exhaustion is formed directly on the base plate, which means that the opening occupies some part of the base plate, there occurs problem of decrease in effective area for representing picture images in addition to inherent problems of the FED in prior arts such as difficulty in placing getters and low conductance for evacuation due to a small spacing about 200 $\mu$m between the face and base plates.

SUMMARY OF THE INVENTION

The present invention has an object to fabricate a FED device without problems which may occur in the prior FED device and a manufacturing method thereof. The present invention has a particular object to make an easy exhaustion of the gas in the FED panel by forming an auxiliary chamber with various shapes which provides the panel with an auxiliary space and to enlarge the active area of the base plate which produces picture images by forming an opening for exhaustion and an exhaust tube in an auxiliary base plate, not in the base plate as used in conventional method.

A FED of the present invention comprises a base plate where emitters, gate electrodes and cathode electrodes are formed, a face plate composed of a phosphor layer and an anode electrode, a side wall which is formed along with a circumference of the base plate for closing spaces between the face and base plates, an auxiliary chamber which is formed to either a back side or side surface of the base plate, and lead lines which are drawn out to a side surface of the auxiliary chamber.

A method for manufacturing the FED of the present invention comprises the following steps: forming a field emitter on a base plate, forming spacers on the base plate, aligning a face plate where a phosphor layer and an anode electrode are formed in a pixel to an upper portion of the base plate, forming a side wall by pasting frit glass to circumferences of the face and base plates and firing the frit glass, attaching an auxiliary chamber to a back side or on a side surface of the base plate, drawing out a lead line outside from cathode and gate electrodes of the base plate, operating an exhaustion process through the auxiliary chamber, and sealing off an exhaust tube after the exhaustion process.

BRIEF DESCRIPTION OF THE DRAWINGS

The present invention will be better understood from reading the following description of non-limitative embodiments, with reference to the attached drawings, wherein below.

DETAILED DESCRIPTION OF THE INVENTION

Figure 1:
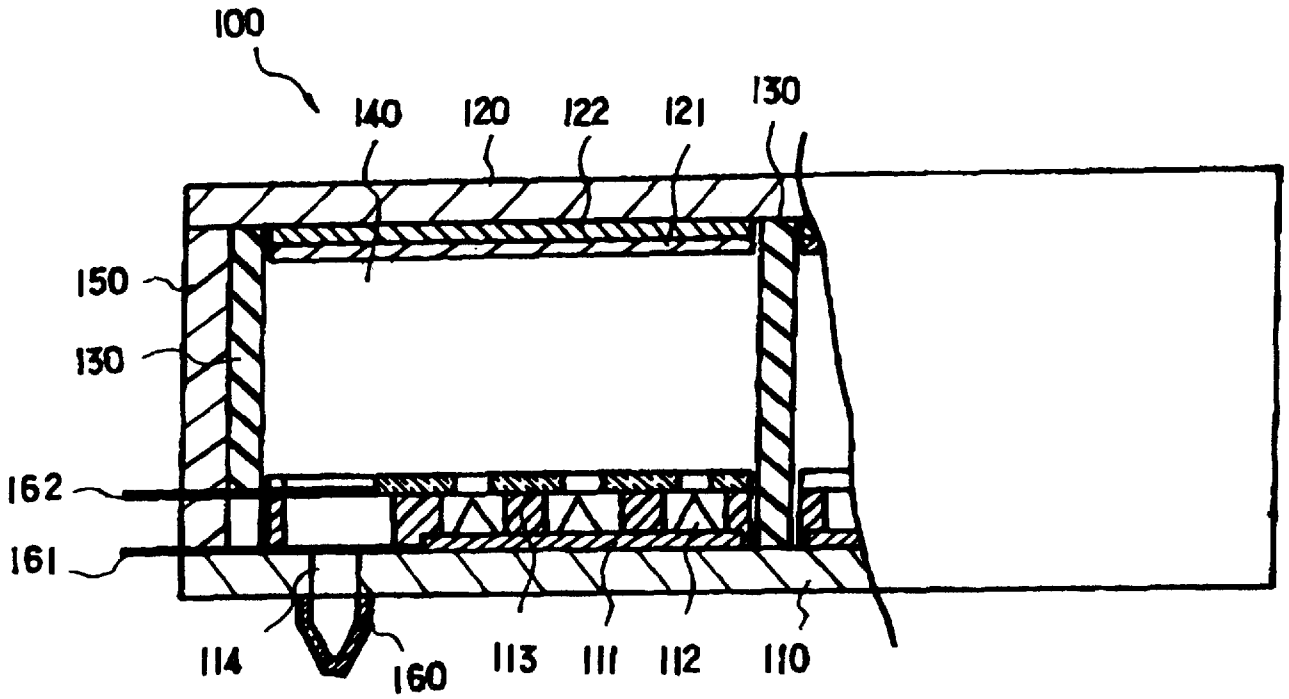
Fig. 1 (PRIOR ART)
FIG. 1 is a cross-sectional view of a FED according to a prior art.

Referring to FIG. 1 a FED according to a prior art is depicted. The FED 100 has a base plate 110 and a face plate 120 which is opposite to the base plate 110. A multiple of electron emission devices each of which is composed of cathode electrodes 111, emitters 112 and gate electrodes 113 are fabricated on the base plate 110 by using thin film and micro-machining technologies. Lead lines 161 and 162 are deposited on base plate 110. Lead lines 161 and 162 are connected through conductive materials to gate electrodes 113 and cathode electrodes 111, which make up electron emission devices formed on the base place 110. A layer of fluorescent material 121 is deposited on the anode electrodes 122, which are formed on the face plate 120 in the reverse direction to a viewer and are made of transparent conductive Indium-Tin-Oxide (ITO). The face plate 120 and base plates 110 are separated with a desired spacing by a number of spacers 130 and a resultingly formed main panel space 140 is maintained in an evacuated state by a side wall 150 which was formed by firing frit glass. Images are produced by emitted lights from phosphor which is activated by bombardment with the electrons ejected from the emitters.

The face plate 120 is oppositely placed to the base plate 110 with a desired separation distance ranging approximately from 100 to 200 $\mu$m by spacers 130 in a manner that the fluorescent material layer 121 and the emitters 112 are oppositely placed each other and form the main panel space 140. The main space 140 is sealed off by firing the assembly after coating each edge side of the face plate 120 and base plate 110 with a frit glass.

A method for forming the main panel space 140 between the face plate 120 and the base plate 110 is as follows: the first step is to make the face plate 120 be separated from the base plate 110 with a uniform spacing by way of using the spacers 130 and to seal off both edge sides between the face plate 120 and the base plate 110. The second step is to connect the first opening for exhaustion 114 formed on the base plate 110 to a vacuum pump (not shown) and thereafter to exhaust the resident gas in the main space 140 to be in a high-vacuum state. The third step is to cut the exhaust tube 160 by heating the tube in order to separate the FED panel from a vacuum pump (not shown), while the main space 140 is being maintained in a vacuum state.

Figure 2:
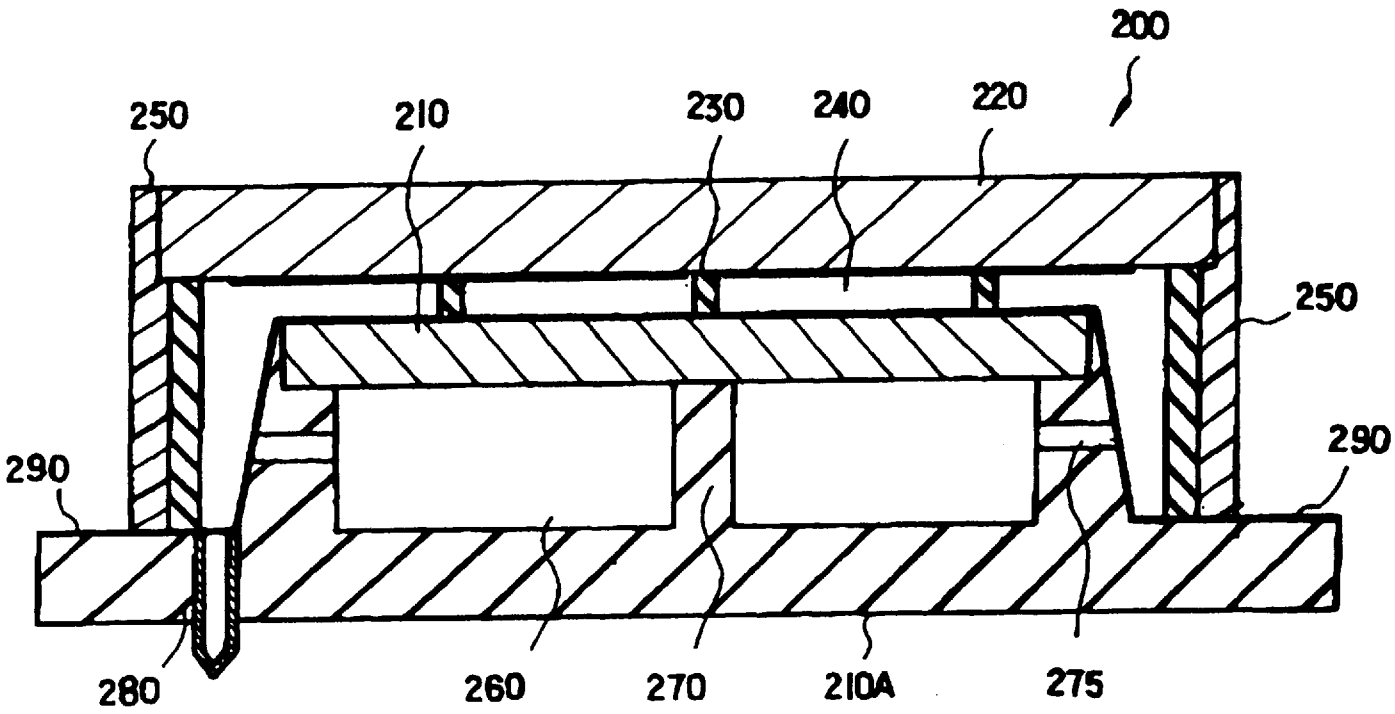
FIG. 2 is a cross-sectional view of an embodiment of a FED having an auxiliary chamber formed with an auxiliary base plate and an auxiliary spacer according to the present invention.

Now referring to FIG. 2, a FED 200 according to an embodiment of the present invention is depicted. A FED according to the present invention is composed of a face plate 220 where a phosphor layer and a transparent electrode are formed in a pixel, a base plate on which cathode and gate electrodes, and emitters are formed, a side wall 250 is formed for sealing between the face plate 220 and auxiliary base plate 210. A spacer 230 is formed for maintaining the constant space between the face plate 220 and the base plate 210. A lead line 290, which must be conductive material and is made of preferably chromium owing to its high adhesion strength and conductivity, is connected with a desired width on the auxiliary base plate 210A to cathode electrodes and gate electrodes which form the electron emission devices by using a screen printing process or sputtering process. In addition, outer surfaces of the auxiliary chamber 260 are formed with slanting surfaces which resultingly function to prohibit the disconnection between the outgoing line for electrodes, the gate electrodes and the cathode electrodes during the process of forming lead lines. The base plate 210 is supported by auxiliary spacer 270. As described above, the face and base plates are separated by a number of spacers 230. The distance between the face plate 220 and the base plate 210 ranges from 30 to 300 $\mu$m. With the configuration above, electrons emitted from the emitters which are formed on the base plate 210 fly through the main panel space 240.

The height of the side wall 250 which is formed between the face plate 220 and the auxiliary base plate 210A is more than five times larger than that of main panel space 240. The side wall 250 is formed by spreading and firing frit glass with a desired width on a circumference of the auxiliary base plate 210A. An opening for exhaustion can be formed between one of the side wall 250 and the auxiliary base plate 210A. After connecting an exhaust tube to the opening for exhaustion, an exhaustion process is performed by a vacuum pump which is connected to the exhaustion tube. If necessary, connection holes 275, which are used for the free movement of gas molecules in between the auxiliary chamber 260 and the panel space 240, can be made in desired portions of auxiliary side wall, the side surface of the auxiliary base plate 210A, can be made in desired portions of the auxiliary base plate 210A. An exhaust tube 280 is sealed off following the exhaustion process described above when the pressure of the main panel space 240 reaches the desired low value.

The exhaustion system comprises the opening for exhaustion which is formed on the auxiliary base plate 210A and the exhaust tube which functions to connect the opening for exhaustion to a vacuum pump (not shown). The degree of vacuum of the panels 240 can be furthermore enhanced by activating getters (not shown) between the auxiliary chamber 260 and the panels 240 or in the auxiliary chamber 260.

Figure 3:
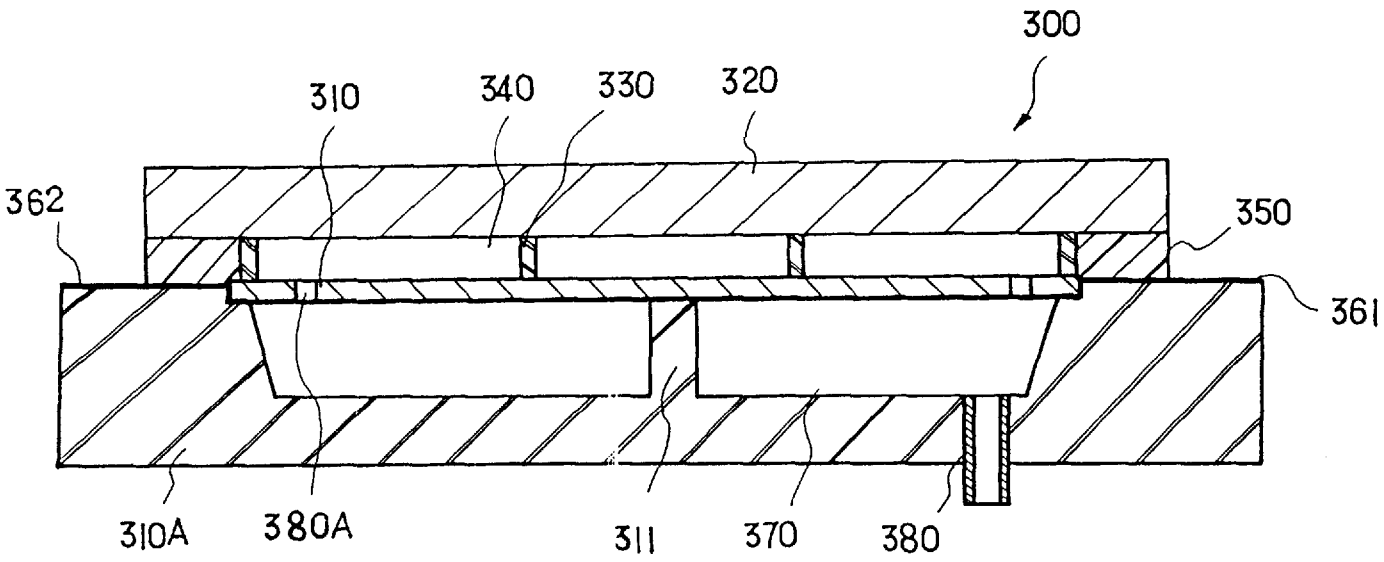
FIG. 3 is a cross-sectional view of another embodiment of a FED having an auxiliary chamber formed with an auxiliary base plate and an auxiliary spacer according to the present invention.

FIG. 3 shows another example of a FED 300, which is manufactured according to the present invention, having an auxiliary chamber formed with an auxiliary base plate 310A and an auxiliary spacer 311. The volume of the auxiliary chamber is more than 10 times larger than that of the main panel space 340.

With the same configuration as described in FIG. 2, a face plate 320 comprises a phosphor layer an anode electrode which are formed in a pixel and a base plate 310 composed of emitters and a first opening 380A for exhaustion which is formed on a portion where emitters are not formed. An auxiliary base plate 310A for forming the auxiliary chamber is manufactured such that an auxiliary space 370 have a constant height. In the center of the auxiliary base plate 310A, the auxiliary spacer 311 for supporting the base plate 310 is set up. The auxiliary base plate 310A is made of glass and connected to the back surface of the base plate 310 in order to reinforce the mechanical strength of the base plate 310.

Outgoing lines 361 and 362 are deposited on the auxiliary base plate 310A. Thereafter the outgoing lines 361 and 362 are connected through conductive materials to gate electrodes and cathode electrodes which make up electron emission devices formed on the base plate 310, which resultingly leads to form lead lines. That is, by depositing a conductive material with a desired width on one surface of the auxiliary substrate 310A for supporting the base plate 310 of the FED 300 by using a screen printing process or a sputtering process, a multiple of lead lines 361 and 362 for electrodes are formed. In addition, a groove for inserting the base plate 310 into the auxiliary base plate 310A is prepared in order to prohibit the electrical disconnection between the lead lines 361 and 362 for electrodes and the electron emission devices due to a step which is formed by the altitude difference between the base plate 310 and the auxiliary base plate 310A and around which discontinuity in lead lines during deposition process can occur. The altitude difference of the step may be reduced by spreading a sealant 350 such as frit glass or an adhesive, etc. to adjacent portions of the base plate 310 and the auxiliary base plate 310A. The face plate 320 and the base plate 310 are separated with a desired spacing by a number of spacers 330. Thereafter, the panels 340 are enclosed by the side wall along with circumferences of the face plates 320 and the auxiliary base plate 310A.

In order to evacuate the panel 340, a second opening for exhaustion is formed at a portion of the auxiliary base plate 310A. The second opening for exhaustion is connected to a vacuum pump (not shown) through a cylindrical exhaust tube 380. During pumping operation, gases remaining in the panels 340 are exhausted via auxiliary chamber 370, and thus the panels 340 and the auxiliary chamber 370 are evacuated into a vacuum state. Finally, a FED having auxiliary chamber can be obtained by melting off the exhaust tube 380.

Figure 4:
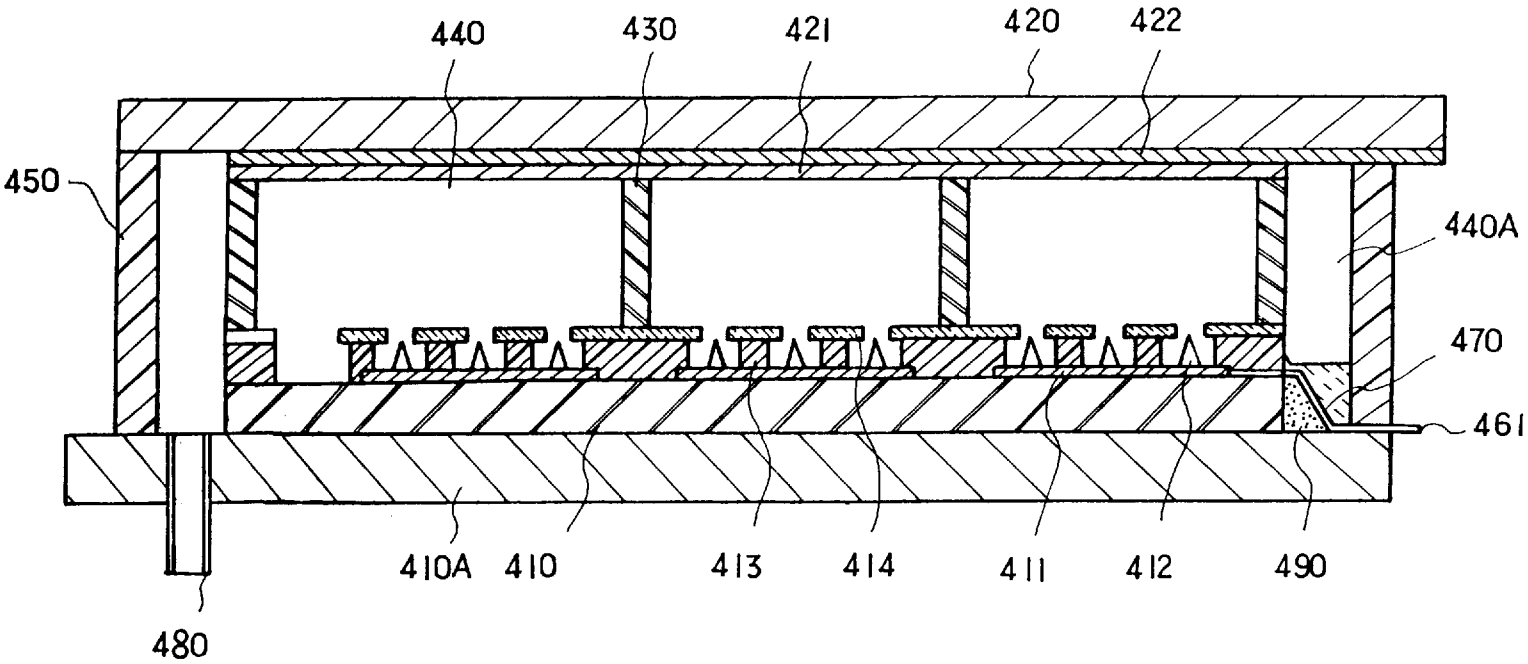
FIG. 4 is a cross-sectional view of an embodiment of a FED having an auxiliary chamber which is formed with a cooperation of a face plate and a side wall formed on an auxiliary base plate according to the present invention.

FIG. 4 shows in detail a FED device having an auxiliary base plate 410A and a side auxiliary chamber 440A, according to another embodiment of the present invention. A face plate 420 is formed in a pixel and comprises a phosphor layer 421 and an anode electrode 422. A base plate 410 is composed of field emitters 412, cathode electrodes 411, insulators 413, and gate electrodes 414. The auxiliary base plate 410A which is made of plate glass is attached to the base plate 410, which is mainly made of silicon, in order to reinforce the mechanical strength of the base plate 410. The size of the auxiliary base plate 410A is almost the same as that of the face plate 420, while the size of the base plate 410 is smaller than that of the auxiliary base plate 410A. Also, a multiple of outgoing lines 461 are formed by deposition of a conductive material separated with a desired spacing on the auxiliary base plate 410A. Thereafter, a thin-film metal or a conductive wire 470 is connected to both the outgoing lines 461 and a cathode electrode 411 forming electron emission devices on the base plate 410 for electrodes. The conductive material forming the outgoing lines 461 for electrodes is preferably made of chromium which has desirable properties in adhesion strength and conductivity. In order to prohibit the electrical disconnection of the thin-film metal or the wire 470 which electrically connects the outgoing lines for electrodes 461 to the electron emission devices due to a step around the edge of the base plate 410, a slanting surface is formed by spreading a non-conducting material 490 such as frit glass or an adhesive along with the circumference of the base plate 410.

A method for manufacturing the above FED is as follows. The face plate 420 and the base plate 410 are separated with a desired spacing by a number of spacers 430 which resultingly leads to panels 440. Thereafter, the panels 440 and a side auxiliary space 440A are enclosed by forming side wall 450 which seal the face plate 420 and the auxiliary base plate 410A. The opening for exhaustion which is formed at a desired portion of the auxiliary base plate 410A, is connected to a vacuum pump (not shown) through a cylindrical exhaust tube 480. Gases remaining in the panels 440 are pumped out via the exhaust tube 480 during evacuation process, and thus the panels 440 are evacuated into a high vacuum state. Finally, a FED having panels 440 and the side auxiliary space 440A which are maintained in a vacuum state can be obtained by tipping off the exhaust tube 480.

One of the advantages accomplished with the present invention as described above is to maximize the operational area for providing information compared with the FED of prior arts with the same sized base plate because opening for exhaustion of the FED of the present invention is made at the auxiliary base plate 410A not in base plate 410. Another advantage of the present invention lies in that an exhaustion of gases and a set-up of getters can be easily carried out because the side auxiliary space 440A provides space for placing getters and the total volume of the panels to evacuate become larger than that without an auxiliary chamber.

Figure 5:
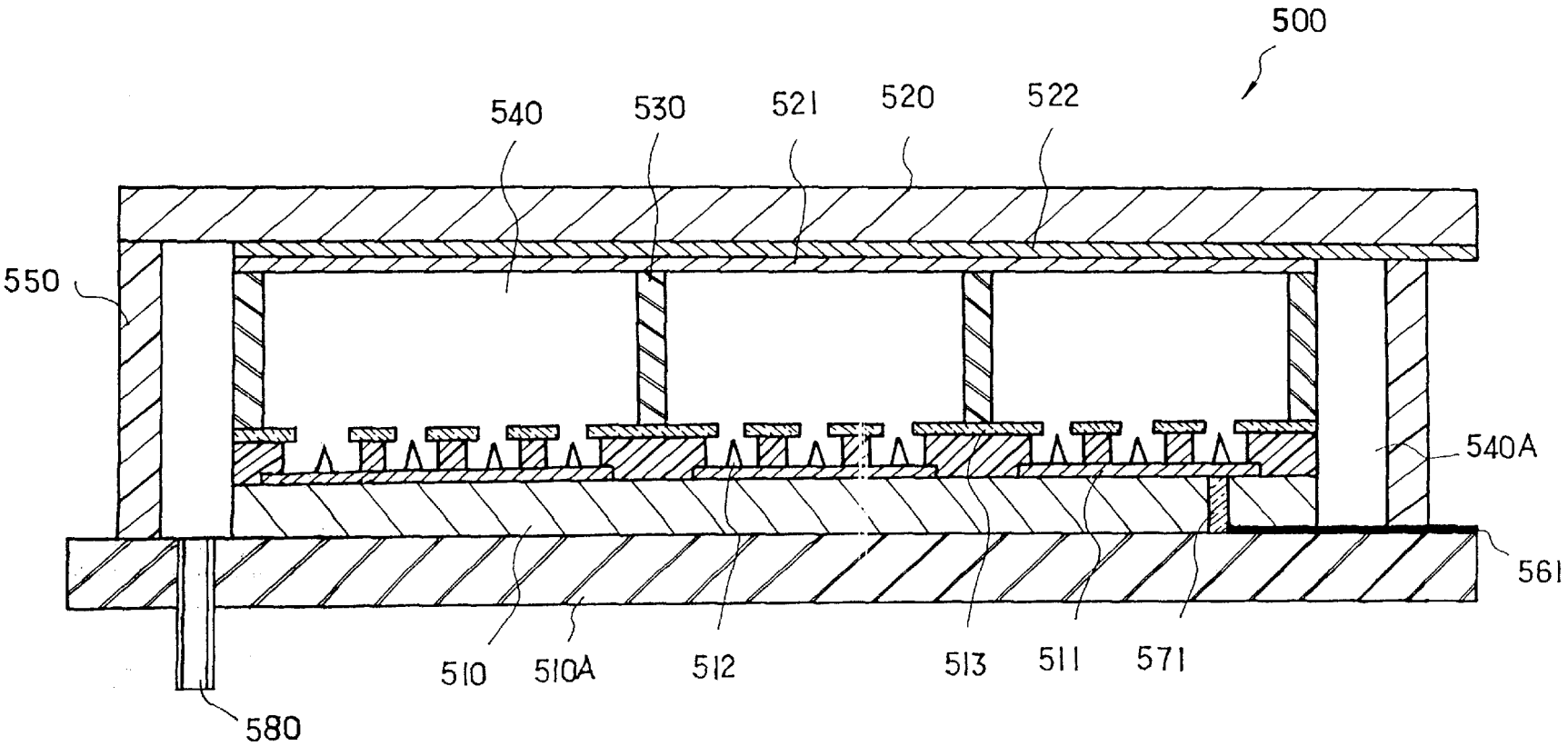
FIG. 5 is a cross-sectional view of another embodiment of a FED device having an auxiliary chamber which is formed with a cooperation of a face plate and a side wall formed on an auxiliary base plate according to the present invention.

FIG. 5 shows another example of a FED device having an auxiliary base plate and an auxiliary space, according to the present invention. The FED 500 comprises a face plate 520 where a phosphor layer 521 and a transparent electrode 522 are formed in a pixel and a base plate 510 where electron emission devices are fabricated. An auxiliary base plate 510A is connected to a backside surface of the base plate 510 and thereafter a lead line 561 is drawn out. Panel spaces 540 which are formed by inserting a multiple of spacers 530 between the face plate 520 and the base plate 510 are maintained in a closed state by a side wall 550 formed by spreading and firing frit glass with a desired width. The electron emission devices formed on the base plate 510 comprises emitter 512, cathode electrodes 511 and gate electrodes 513. A multiple of holes formed with a desired spacing along with the comers of the base plate 510 is filled up with a conductive material 571, which functions to electrically connect the electrodes of the electron emission devices to outgoing lines 561 for electrodes. The panels 540 and a side auxiliary space 540A are evacuated by a pumping operation of a vacuum pump (not shown) which is connected through an exhaust tube set up to an opening for exhaustion which is formed on the auxiliary base plate 510A. The panels 540 and the side auxiliary space 540A which are maintained in a vacuum state can be sealed by tipping off the exhaust tube 580 through a heating process.

Figure 6:
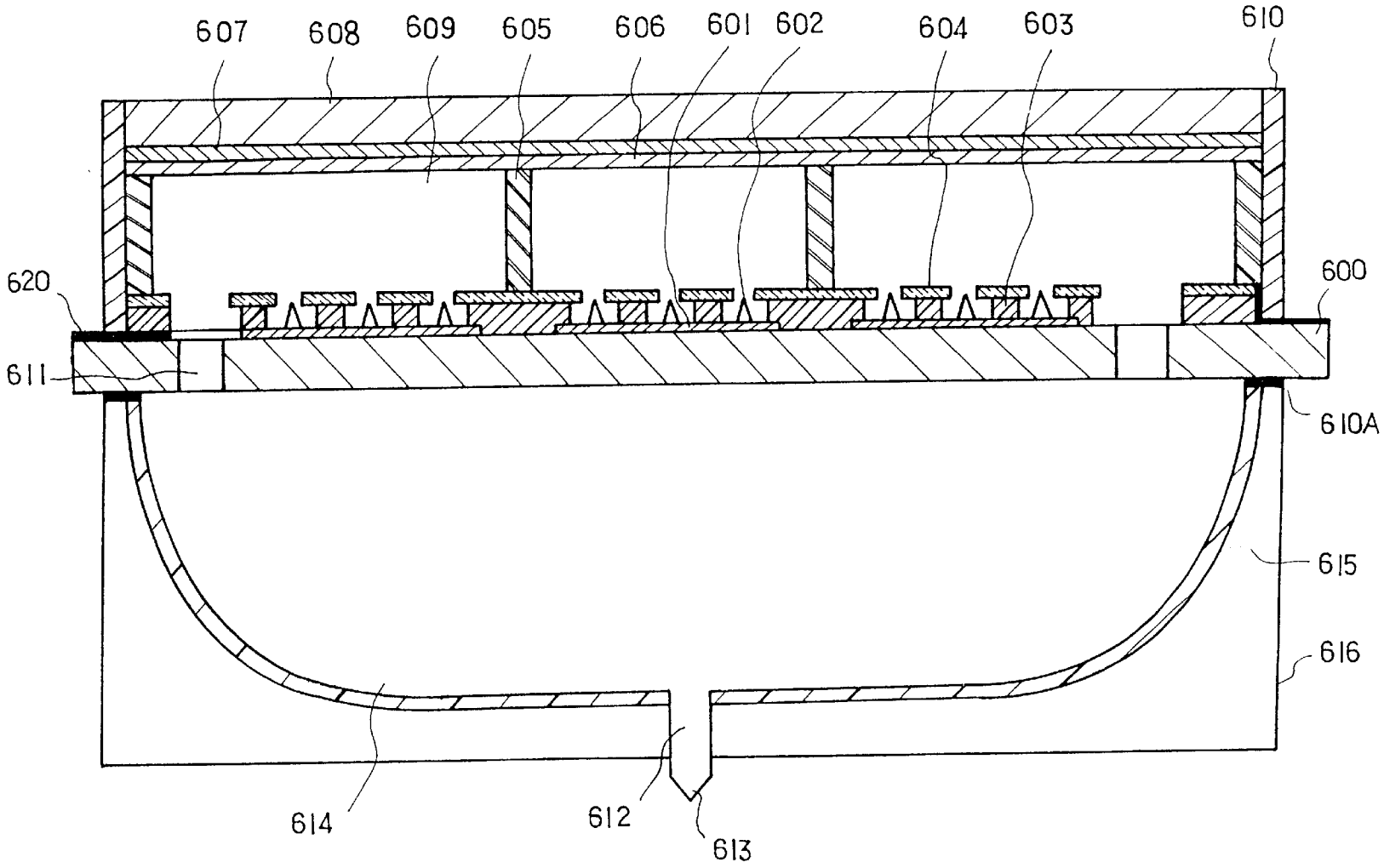
FIG. 6 is a cross-sectional view of an embodiment of a FED having an auxiliary chamber with a hemispherical space according to the present invention.

FIG. 6 shows another embodiment of a FED device having an auxiliary chamber 616 having a hemispherical space, according to the present invention. A detailed description in connection with devices which are formed on a face plate 608 and a base plate 600, and a first opening for exhaust tube 611 may be omitted because the structure and the function thereof are fully described from the above. The face plate 608 is composed of a phosphor layer 606 and an anode electrode 607, and the base plate 600 is composed of field emitters 602, cathode electrodes 601, insulators 603, gate electrodes 604, and outgoing line 620. The face plate 608 and the base plate 600 are separated with a desired spacing number of spacers 605 and a resultantly formed main space 609 is maintained in an evacuated state by a side wall 610, which is formed by firing fit grass. An auxiliary chamber 616 connected to the base plate 600 can be fabricated by a molding method. After pouring glass into a mold for making an auxiliary chamber with a shape of hemisphere, the auxiliary chamber 616 having an internal structure of a hemispheric shape can be obtained. A second opening for exhaustion 612 is formed at one surface of the auxiliary chamber 616. The auxiliary chamber 616 with the second opening for exhaustion 612 is connected, by using frit glass 610A, to the backside surface of the base plate 600. Thereafter, an exhaust tube 613 is inserted into the second opening for exhaustion 612 and a vacuum pumping operation is followed. After completion of the vacuum pumping operation, a FED can be obtained by melting off the exhaust tube 613 using a torch lamp or laser beam. In this case, gases which may remain in the auxiliary space 614 after the process of tipping off the tube can be removed by activating getters 615 in the auxiliary chamber 614.

Figure 7:
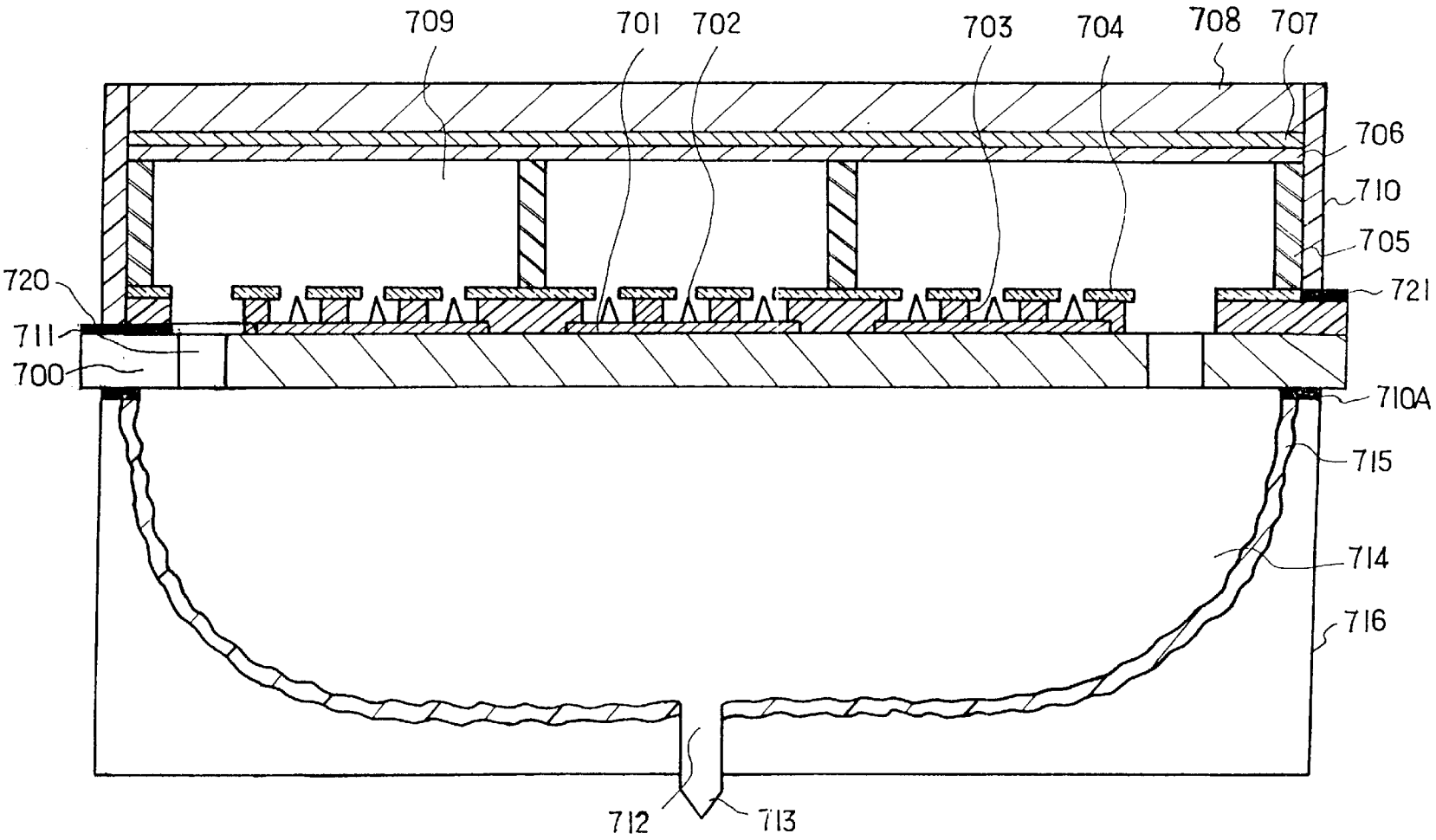
FIG. 7 is a cross-sectional view of another embodiment of a FED having an auxiliary chamber with rugged hemispherical space according to the present invention.

FIG. 7 shows another embodiment of a FED device having a auxiliary chamber 714 having a rugged hemispherical space internally, according to the present invention. The FED has a base plate 700 and a face plate 708 which is opposite to the base plate 700. The face plate 708 is composed of a phosphor layer 706 and an anode electrode 707, and the base plate 700 is composed of field emitters 702, cathode electrodes 701, insulators 703, and gate electrodes 704. The face plate 708 and the base plate 700 are separated with a desired spacing number of spacers 705 and a resultantly formed main space 709 is maintained in an evacuated state by a side wall 710, which is formed by firing fit grass. A method for manufacturing the FED device, a method for forming outing lines 720 and 721 for electrodes, and interconnecting method for a lead line, which are described in FIG. 7, are the same as those in FIG. 6. Only the difference between FIGS. 6 and 7 is that an auxiliary chamber to be connected to a base plate 700 described in FIG. 7 is made to have a hemispheric space with a rugged inner wall. The auxiliary chamber 716 having an internal structure of a hemispheric shape can be obtained by pouring glass into a mold for making an auxiliary chamber with a shape of hexahedrons. Also, when manufacturing a mold for the auxiliary chamber 716, the exhaust tube 713 can be made simultaneously with an integration of the auxiliary chamber 716 by makings the mold having a shape of tube which is to be formed to a side surface of the auxiliary chamber 716. Therefore, a process for inserting and fixing the exhaustion tube 713 can be eliminated by forming an opening for exhaustion 712 to a side surface of the auxiliary chamber 716 having the hemispherical inner wall which is made as described above.

There are two methods to fabricate the auxiliary chamber 716 having rugged inner wall. One method is to manufacture a rugged shape simultaneously with manufacturing the auxiliary chamber 716 by forming the rugged shape in the mold itself. Another method is to form getters 715 along with a concave-convex shape by activating the getter 715 of evaporation type in order for the getter 715 to have a concave-convex shaped inner wall by a post processing step such as a chemical etching or a mechanical grinding methods after fabricating the auxiliary chamber 716 with a flat inner wall. The hemispherical shaped auxiliary chamber 716, the concave-convex getter 715, and the auxiliary chamber having the exhaust tube 713 as described from the above is connected by using frit glass 710A to the backside surface of the base plate 700 on which the first opening for exhaustion 711 is formed. A vacuum pump is connected to the exhaustion tube 713 which is formed in the auxiliary chamber 716 and thereafter a vacuum pumping operation is performed.

When the degree of vacuum of panels 709 and the auxiliary space 714 reaches a desired level, a FED device can be obtained by tipping off the exhaust tube 713 using a torch lamp or laser beam. Therefore, the type of display devices shown in FIGS. 6 and 7 has a structure of a hemispheric shape internally which is most suitable for exhaustion. The manufacturing of the panels 609 and 709 are made in a conventional method. The volume of the auxiliary space 614 and 714 should be made more than ten times larger than that of the panels 609 and 709, as described in FIG. 3.

In accordance with the present invention as described in detail above, more larger picture plane can be obtained with the same base plate as that of prior arts, because outgoing lines which are drawn out for connecting from cathode electrodes and gate electrodes of emitters are connected onto an auxiliary base plate. In addition, another advantage accomplished with the present invention is that conductance is increased, when performing exhaustion process, owing to having a larger auxiliary tank compared with the prior exhaustion process performed with a less voluminous panel, because the exhaustion process in the present invention is performed by using an auxiliary chamber, and furthermore a getter can be easily set up due to the existence of the auxiliary space.

While the FEDs as herein disclosed and shown in detail are fully capable of obtaining their objects and advantages stated above, it is to be understood that same are merely illustrative of the presently preferred embodiments of the present invention and that no limitations are intended to the details of structure or design or method herein shown other than described in the appended claims.

What is claimed is:

1. A field emission display comprising:

a face plate where a phosphor layer and a transparent electrode are formed in a pixel;

a base plate comprising emitters, cathode electrodes and gate electrodes;

an auxiliary base plate with an auxiliary side wall, supporting grooves formed in an outer direction of circumferences of openings of said auxiliary side wall, auxiliary spacer supporting said base plate, and lead lines for an electrode which are formed on spacers formed for maintaining a constant space between said face plate and said base plate; and a side wall formed for sealing between said face plate and said auxiliary base plate.

2. The field emission display according to claim 1, wherein the constant space between said face plate and said base plate has a range from 30 to 300 $\mu$m.

3. The field emission display according to claim 1 further comprising an exhaustion system formed on said auxiliary base plate for creating a vacuum state in the constant space between said face plate and said base plate.

4. The field emission display according to claim 3 wherein said exhaustion system comprises an opening for exhaustion which is formed on said auxiliary base plate and an exhaust tube for connecting said opening to a vacuum pump.

5. The field emission display according to claim 4 wherein a number of openings for free movement of gas molecules are formed in said auxiliary side wall.

6. The field emission display according to claim 1 wherein said side wall is formed with being extended upwardly at positions separated with a desired spacing from said auxiliary base plate.

7. The field emission display according to claim 6 wherein a height of said side wall is more than five times larger than that of the constant space between said face plate and said base plate.

8. A field emission display comprising:

a face plate on one side of which an anode electrode and a phosphor layer are formed in sequence;

a base plate which is placed oppositely to said face plate and on one side of which cathode electrodes and emitters are formed;

spacers which form panels between said face plate and said base plate;

a first opening for exhaustion which is vertically formed in one portion of said base plate where said cathode electrodes are not formed;

outgoing lines for electrode which are formed on said base plate;

a lead line for connecting said base plate to said outgoing lines for electrode; and an auxiliary chamber containing an opening for exhaustion having a hemispherical inner space connected to said base plate.

9. The field emission display according to claim 8 wherein an internal wall of said auxiliary chamber has concave-convex shape.

10. The field emission display according to claim 8 wherein a material for said auxiliary chamber is glass.

11. The field emission display according to claim 8 wherein said auxiliary chamber is connected to said base plate by frit glass.

12. The field emission display according to claim 8 wherein said panels of said auxiliary chamber have a asymmetrical hemispheric shape.

13. The field emission display device according to claim 8 wherein a getter material is pasted on said auxiliary chamber.

14. The field emission display device according to claim 8 wherein auxiliary spacers are set up at said auxiliary chamber.

* * * * *

UNITED STATES PATENT AND TRADEMARK OFFICE

CERTIFICATE OF CORRECTION

PATENT NO. : 5,844,360

DATED : Dec. 1, 1998

INVENTOR(S) : JEONG et al.

It is certified that error appears in the above-identified patent and that said Letters Patent is hereby corrected as shown below:

On the title page, item [54] and col.1, line 1, delete " EMMISSION" and replace therefor with --EMISSION--.

Col. 6, line 14: delete "comers" and replace therefor with --corners--.

Signed and Sealed this

Thirtieth Day of March, 1999

*Attest:*

*Attesting Officer*

Q. TODD DICKINSON

*Acting Commissioner of Patents and Trademarks*